US006364646B1

(12) United States Patent
Kirtley et al.

(10) Patent No.: US 6,364,646 B1
(45) Date of Patent: Apr. 2, 2002

(54) ROTARY VANE PUMP WITH CONTINUOUS CARBON FIBER REINFORCED POLYETHERETHERKETONE (PEEK) VANES

(76) Inventors: Kevin R. Kirtley, 19 Heather Dr., Clifton Park, NY (US) 12065; David B. Manner, 15383 Dunn Dr., Traverse City, MI (US) 49686

( * ) Notice: Subject to any disclaimer, the term of this patent is extended or adjusted under 35 U.S.C. 154(b) by 0 days.

(21) Appl. No.: 09/372,120

(22) Filed: Aug. 11, 1999

Related U.S. Application Data

(60) Provisional application No. 60/136,276, filed on May 27, 1999, and provisional application No. 60/148,309, filed on Aug. 11, 1999.

(51) Int. Cl.[7] ..... F04C 18/344

(52) U.S. Cl. ..... 418/152; 418/178; 418/236

(58) Field of Search ..... 418/152, 178, 418/236, 238

(56) References Cited

U.S. PATENT DOCUMENTS

| | | | | | |
|---|---|---|---|---|---|
| 2,491,100 | A | | 12/1949 | Frei | 418/152 |
| 3,191,852 | A | | 6/1965 | Kaatz et al. | 418/152 |
| 3,335,944 | A | * | 8/1967 | Conde et al. | 418/152 |
| 3,433,166 | A | * | 3/1969 | Birkemeier | 418/152 |
| 4,209,286 | A | * | 6/1980 | Schwartz | 418/152 |
| 4,231,727 | A | * | 11/1980 | Buchholz et al. | 418/152 |
| 4,492,545 | A | * | 1/1985 | Mochizuki et al. | 418/152 |
| 4,616,985 | A | | 10/1986 | Hattori et al. | 418/178 |
| 4,804,317 | A | | 2/1989 | Smart et al. | 418/152 |
| 4,820,140 | A | | 4/1989 | Bishop et al. | 418/152 |
| 5,087,180 | A | * | 2/1992 | Clapp | 418/152 |
| 5,100,308 | A | * | 3/1992 | Gevelhoff et al. | 418/152 |
| 5,131,818 | A | | 7/1992 | Wittkop et al. | 417/273 |
| 5,181,844 | A | | 1/1993 | Bishop et al. | 418/152 |
| 5,769,618 | A | | 6/1998 | One et al. | 418/48 |
| 5,873,697 | A | | 2/1999 | Gully | 415/106 |
| 6,027,323 | A | * | 2/2000 | Martensen et al. | 418/267 |

FOREIGN PATENT DOCUMENTS

| | | | | |
|---|---|---|---|---|
| DE | 4033455 | * | 4/1992 | 418/152 |
| GB | 2074247 | | 10/1981 | |
| JP | 59-201990 | * | 11/1984 | 418/178 |
| JP | 61-277888 | | 8/1986 | |
| JP | 62-276291 | | 1/1987 | |
| JP | 1-182592 | * | 7/1989 | 418/178 |
| JP | 4-76298 | * | 3/1992 | 418/152 |
| JP | 4-159483 | * | 6/1992 | 418/178 |

* cited by examiner

*Primary Examiner*—John J. Vrablik
(74) *Attorney, Agent, or Firm*—Daneker, McIntire, Schumm, Prince, Goldstein et al., P.C.

(57) ABSTRACT

A rotary paddle pump with sliding vanes and stationary side plates fabricated from a continuous carbon-fiber reinforced polyetheretherketone (PEEK) material yields characteristics of self-lubrication for dry operation, low wear for long life, and high flexural and tensile strength for superior resistance to foreign object damage. Other parts manufactured from PEEK may be alternately substituted to provide self-lubrication and low wear on surfaces moving relative to each other.

19 Claims, 5 Drawing Sheets

ROTARY VANE PUMP WITH CONTINUOUS CARBON FIBER REINFORCED POLYETHERETHERKETONE (PEEK) VANES

This application is a continuation of Provisional Application 60/136,276 filed May 27, 1999, and Provisional Application 60/148,309 filed Aug. 11, 1999.

TECHNICAL FIELD

The present invention relates to sliding vane rotary paddle pumps, and in particular to a rotary paddle pump having continuous carbon fiber reinforced polyetheretherketone (PEEK) sliding vanes and other parts that provide longer operational life from low wear rates and a low propensity of catastrophic failure due to foreign object impact damage.

BACKGROUND OF THE INVENTION

Rotary paddle pumps using sliding vanes are in wide application for moving air or other fluid or for evacuating closed vessels. Rotary paddle pumps are, in general, composed of a rotating rotor, sliding vanes, side plates, and a mechanical means to drive the rotating rotor. A circular shroud with an eccentrically displaced rotor or an oval shroud with a centrically placed rotor contains the motion of the sliding vanes. The vanes slide in and out of radial groves which are cut into the rotor along its entire length. Centripetal acceleration during rotation of the rotor forces the vanes into sliding contact with a stationary shroud. The extension and retraction of the vanes against the shroud provides the variation in volume of each chamber of a multi-vaned pump necessary to move air through the device. Side plates then form the complete enclosure of the alternately contracting and expanding volume between paddles. Intake and exhaust ports which deliver and collect air flowing into and out of the working volumes of the pump can be established in the shroud or side plates. During operation of the pump, the vanes slide inwardly and outwardly in the grooves in the rotor and the edges of the vanes are in constant sliding contact with the side plates and shroud. The zero clearance is required to avoid leakage which diminishes the efficiency of the pump.

With zero clearance between rotating and non-rotating components, rotary paddle pumps for moving air require self lubricating materials or air-lubricant separators to avoid contamination of the air stream. An early application of a self lubricating carbon graphite composite material for all parts in sliding contact is disclosed in U.S. Pat. No. 3,191,852 issued to Kaatz et al. The Kaatz design used the carbon graphite composite material for both the vanes and the rotor. These carbon-based parts were primarily made by compressing carbon graphite and various organic binders under high temperature and pressure. Unfortunately, carbon parts made in this manner exhibit poor tensile strength and propensity to fracture and chip which leads to failure of the pump. These failures tend to be catastrophic, especially if foreign objects are ingested. Attempts have been made to minimize the number of carbon parts as disclosed in U.S. Pat. No. 4,804,317 issued to Smart et al. and U.S. Pat. No. 4,198,195 issued to Sakamaki et al. or by replacing the carbon parts with stronger carbon-based parts or other materials coated with a self-lubricating coating. As disclosed in U.S. Pat. No. 4,820,140, Bishop used metallic parts with a self-lubricating lead filled polytetrafluoroethylene (PTFE) coating as side wear plates but not the sliding vanes themselves. The coating prevents oxidation of the stationary components in sliding contact with the vanes and rotor which can lead to pump failure by presenting a roughened surface which can cause fracturing and high wear of the carbon-based material. Later, in U.S. Pat. No. 5,181,844, Bishop et al. disclosed a strengthened carbon vane. The new material was composed of carbon or graphite fibers formed into a cloth weave and held in a densified carbon matrix. Laminates of the carbon/carbon material were used in their preferred embodiment. Further, the carbon vanes were impregnated with a TEFLON based thermoplastic for claimed improved wear resistance. Claimed to be more dependable and consistent in performance, the carbon/carbon composite is still susceptible to chipping and fracture.

SUMMARY OF THE INVENTION

In order to address the drawbacks associated with the prior art carbon and carbon/carbon vanes, rotors, and or side plates, the present invention uses continuous carbon fiber reinforced polyetheretherketone for the sliding vanes, and the portion of stationary air transfer side plates in contact with the moving rotor. Polyetheretherketone is an aromatic polymer whose construction consists of ether, ketone, and phenyl groups. Unfilled and unreinforced PEEK has a low coefficient of friction and exhibits self-lubricating character but lacks the strength and rigidity necessary for application to vaned rotary pumps. By reinforcing the PEEK with a carbon-fiber weave, the material becomes very strong and has a low coefficient of thermal expansion while maintaining the required self-lubricating character of the material used in prior art but being more resistant to fracture and chipping. The carbon-fiber reinforced PEEK also maintains these characteristics at very high sliding contact speeds making it suitable for unlubricated operations. Normally fabricated by winding continuous carbon-fiber impregnated with PEEK resin onto a mandril to form circular bearings, the present invention employs carbon-fiber reinforced PEEK which has been laid in flat sheets with varying fiber bias and cured in an autoclave. The thickness is established by combining a plurality of laminated fiber layers and the final shape is then machined to the desired dimension.

While employing a metallic rotor and shroud, the continuous carbon-fiber reinforced PEEK is employed in the sliding vanes. Further, continuous carbon-fiber reinforced PEEK, the preferred embodiment, is utilized in the portion of the stationary components, namely the air transfer side plates, in contact with the metallic rotor. In doing so in the preferred embodiment, a minimum of non-metallic parts are employed. The carbon-fiber reinforced PEEK does not need an additional coating since it does not oxidize and is already self-lubricating. In this embodiment, the invention exhibits characteristics necessary for application in an unlubricated rotary paddle pump, namely, self-lubricating, high flexural and tensile strength, low coefficient of friction, low coefficient of thermal expansion, low wear and nearly complete resistance to chemical attack. It is also possible to form the rotor and the shroud from carbon-fiber reinforced PEEK. Pump parts manufactured from continuous carbon-fiber reinforced PEEK exhibit dependable and consistent performance over a wide range of temperatures and atmospheric conditions.

BRIEF DESCRIPTION OF THE DRAWINGS

A more complete understanding of the continuous carbon fiber reinforced polyetheretherketone rotary paddle pump, including sliding vanes of the present invention may be had by reference to the following Detailed Description when taken in conjunction with the accompanying Drawing wherein:

FIG. 2 uses the same mechanical principle as FIG. 1, but shows alternate use of pinions with one fixed to the end cap an the other like FIG. 1 integrated with a driving shaft.

DETAILED DESCRIPTION OF THE DRAWINGS

Figures 1, 1A:
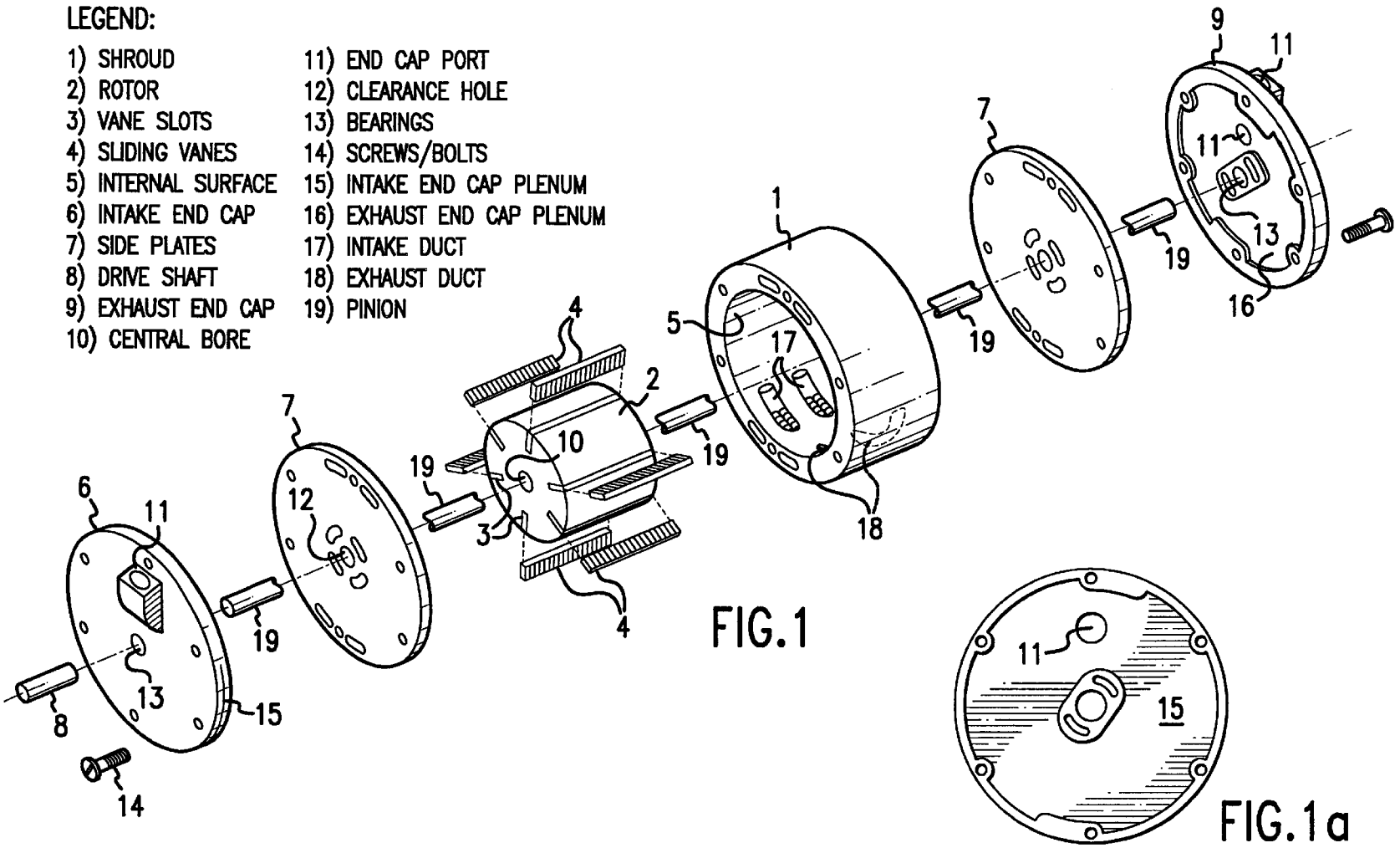
FIG. 1 shows an exploded perspective view of a sliding vane rotary paddle pump utilizing continuous carbon fiber reinforced polyetheretherketone material vanes.
FIG. 1*a* is the interior detail of the intake end cap plenum (15) with the end cap port (11).

In the preferred embodiment, the sliding vane rotary paddle pump is used to move air across the gyroscope instruments in piston powered aircraft. Most piston engines for aircraft include an accessory drive which provides power to a spline shaft on the accessory case. The spline shaft accepts the main driving shaft of the rotary paddle pump described herein and is the sole means of powering the device. Referring now to FIG. 1, a metallic shroud 1 is shown encasing a rotor 2 for the sliding vane rotary paddle pump shown in exploded perspective view. The rotor 2 is preferably metallic, of circular cross-section and has a plurality of radial vane slots 3 symmetrically displaced and cut along the entire length of the rotor. A plurality of sliding vanes 4 are disposed in the radial vane slots 3 for slidable movement to engage the internal surface 5 of the shroud 1 and to pump fluid through the rotary paddle pump. The width of each slot is sufficiently large to accept the sliding vanes 4. The sliding vanes 4 are made of continuous carbon-fiber reinforced PEEK. The sliding vanes 4 may be located directly along radial lines from the center of the rotor 2, or may be in radial vane slots 3 canted with respect to a radial line from center of the rotor 2.

The shroud 1 is ovoid and concentric with the rotor, is equal in length to the rotor's length parallel to the drive shaft 8 on which the rotor 2 is mounted, and the shroud forms the outer end of the pump's working volumes.

The shroud 1 has an intake duct 17 and an exhaust duct 18 which ventilate the working volumes of the pump. A pair of air transfer side plates 7 are positioned adjacent to the rotor 2 with the interior surfaces of the plates facing the end surfaces of the rotor 2. The air transfer side plates have apertures coinciding with the intake and exhaust ducts through the periphery of the shroud 1, examples of which are shown as intake duct 17 and exhaust duct 18. Normally there would be a number of such intake ducts 17 and exhaust ducts 18 ported to the internal surface 5 of the shroud 1 and to the end surface of the shroud 1 adjacent to the side transfer plate 7. The ports of the exhaust duct(s) 18 on the internal surface 5 of the shroud 1 would be located to exhaust the working volume near the minimum working volume of the pump. The ports of the intake duct(s) 17 on the internal surface 5 of the shroud 1 would be located to intake fluid into the working volume near the maximum working volume of the pump. Porting and ducting, with plena and ports according to the same principles, can also pierce directly through the side of the shroud 1.

The sliding vanes are sized so that they can slide in an unrestricted manner inwardly and outwardly in the radial vane slots 3 in the rotor 2, so that they are in contact with the slide plates, and so that they can remain partially in the slot 3 when fully extended in contact with the ovoid shroud 1. Also shown in FIG. 1 are ports located centrally on the side transfer plates 7 just exterior to a clearance hole 12 located near the center of the rotor. The rotor may be ducted so that in combination with the ports located centrally on the side transfer plates fluid pressure may be modulated on the sliding vanes intermittently during a pump cycle.

Each working volume is then comprised of the shroud 1, two air transfer side plates 7, two sliding vanes 4, and the rotor 2.

Figures 2, 2A:
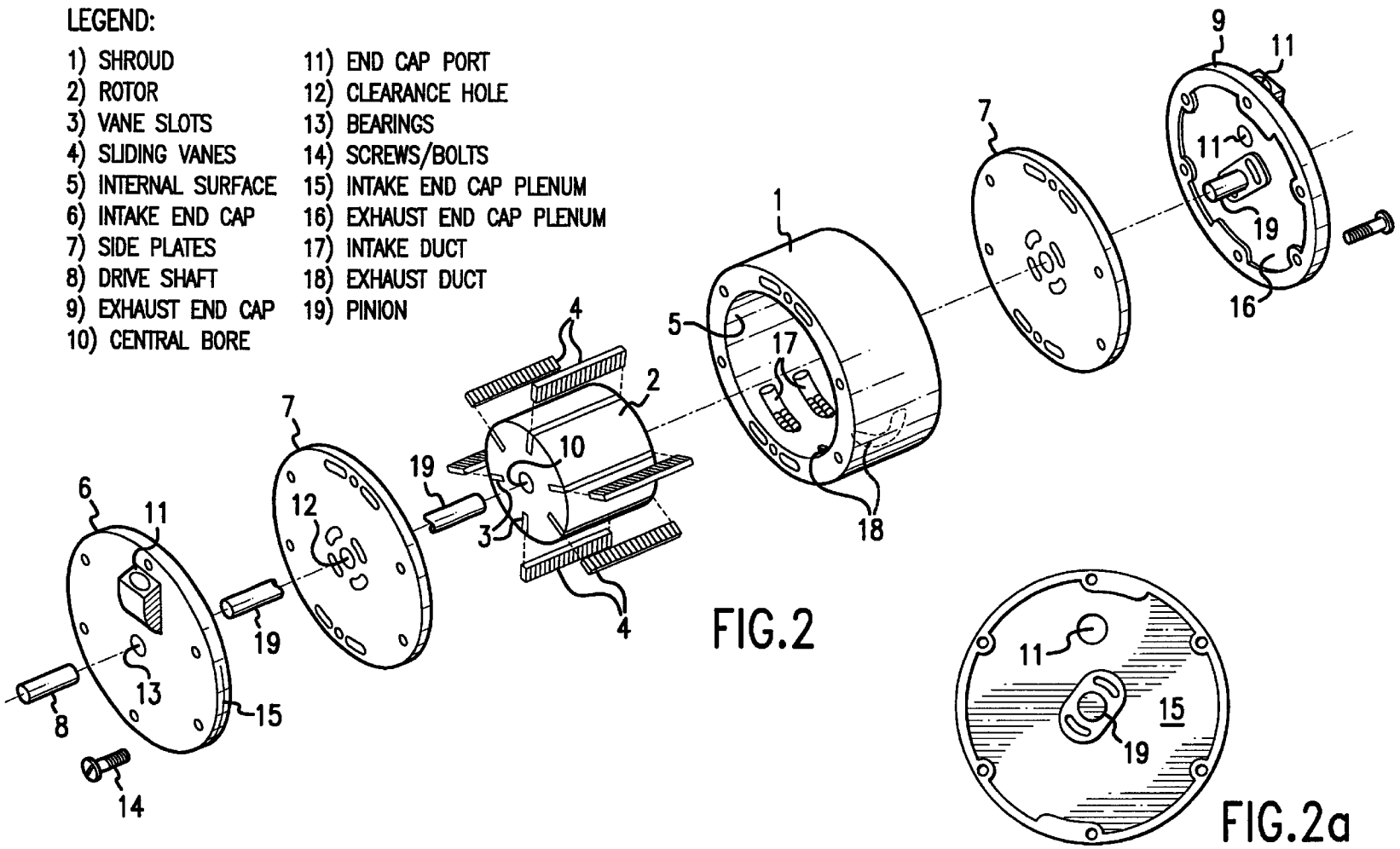
FIG. 2 is similar to FIG. 1 with the additional illustration of a pinion (19).
FIG. 2*a* is identical to FIG. 1*a* with the additional illustration of a pinion (19).
Figure 3B:
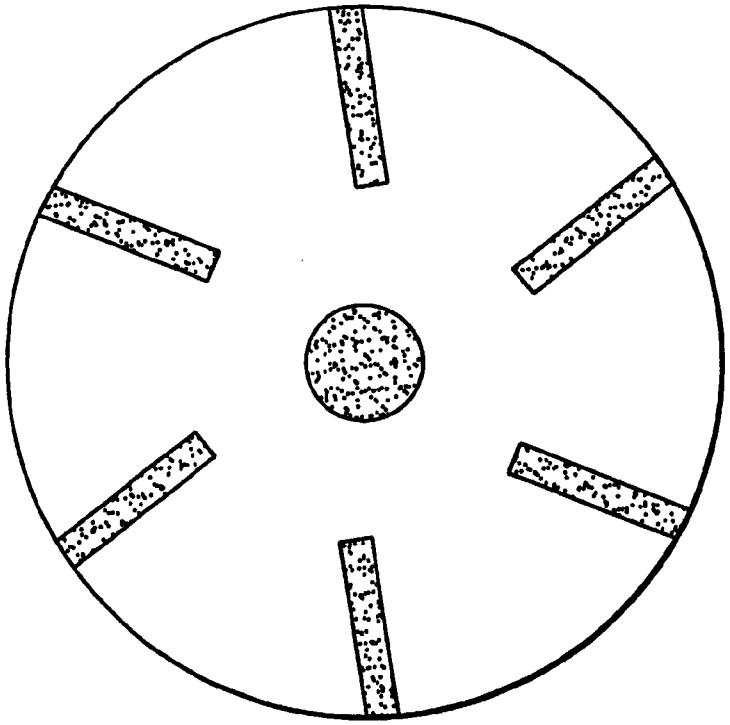
FIG. 3 illustrates the contrast between radially perpendicular vane slots ((3) in FIGS. 1 and 2) shown in FIG. 3*a* and canted vane slots shown in FIG. 3*b*.
Figure 3A:
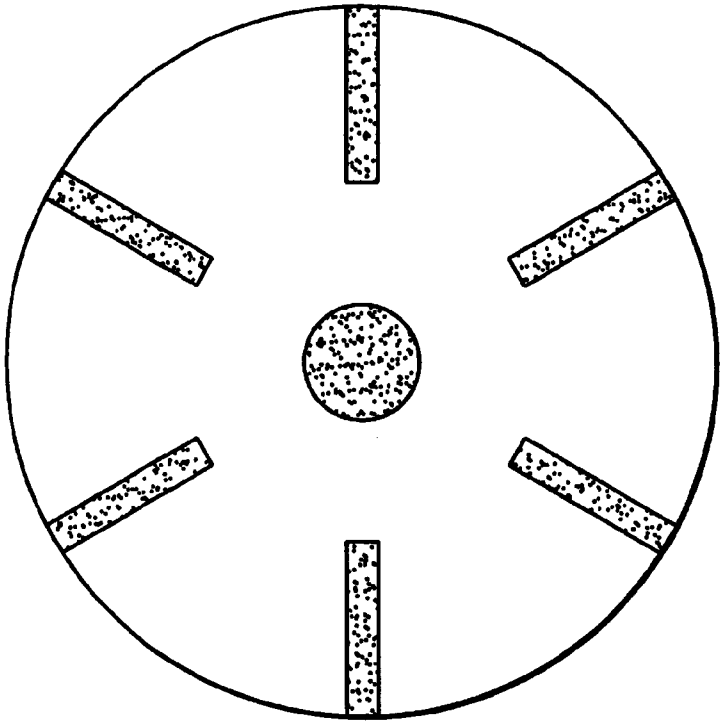
Figure 4A:
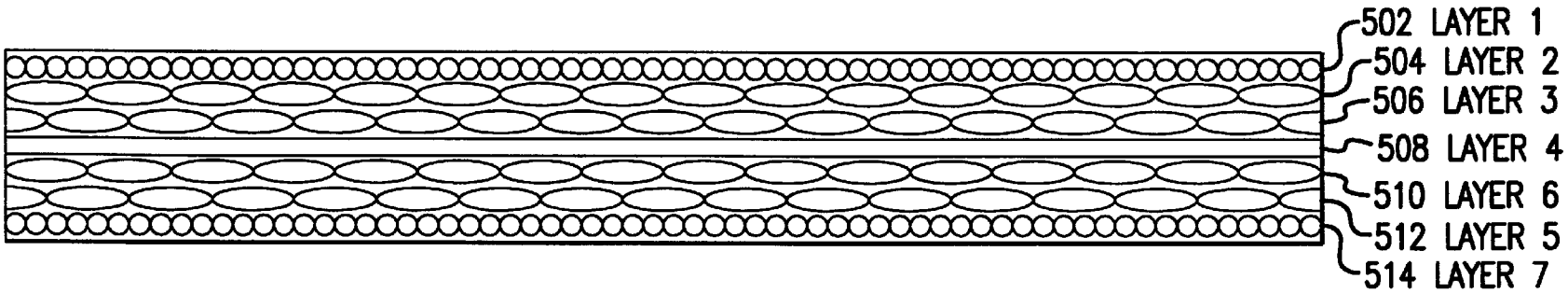
FIG. 4A illustrates an example of layering of the PEEK vanes.
Figure 4B:
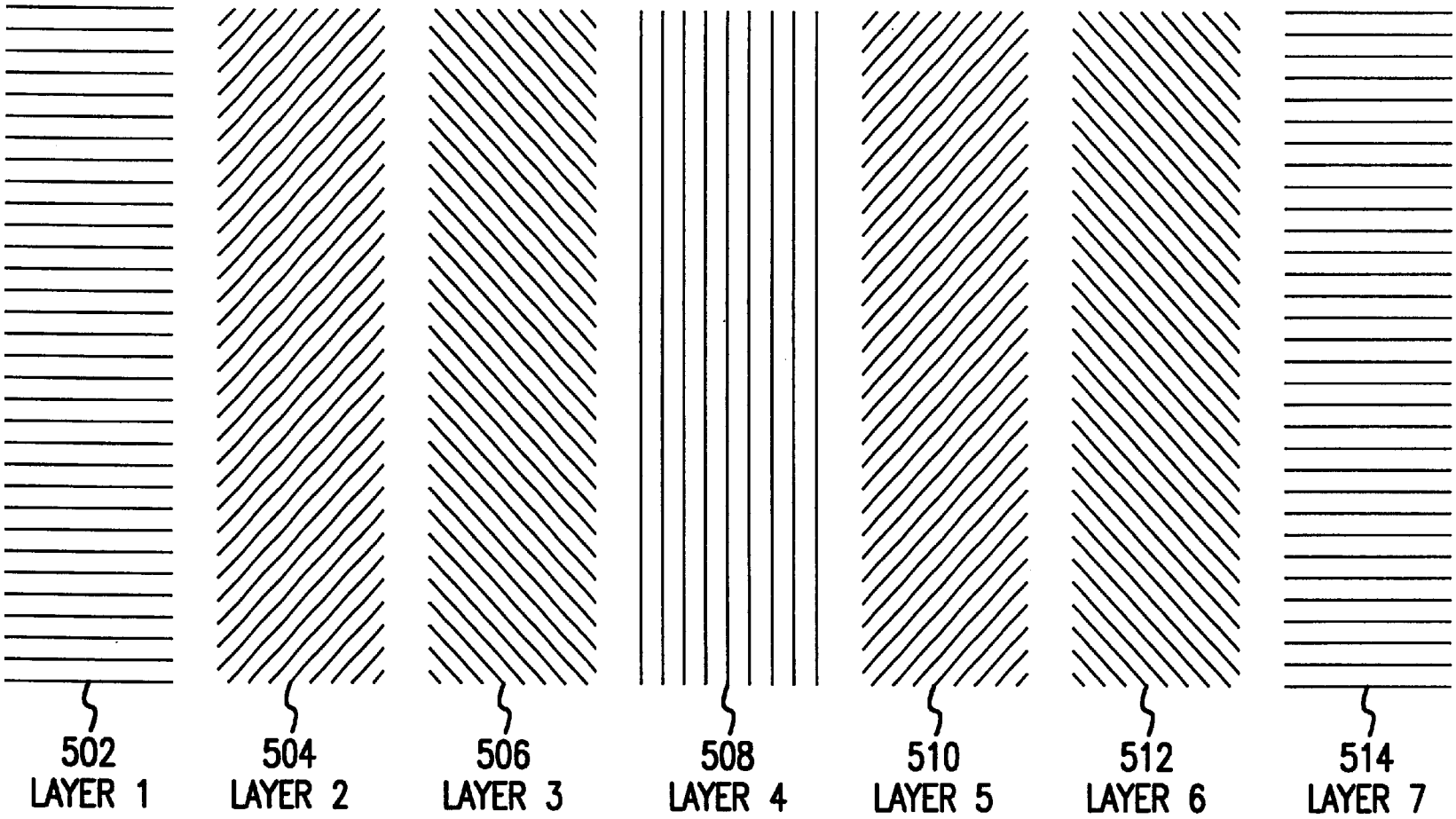
FIG. 4B illustrates an example of a way to bias the layers of FIG. 4A. The numbers 502, 504, 506, 508, 510, 512 and 514 adjacent to the illustrative layers in FIG. 4A are simply to enable easier matching of the illustrative layers in FIG. 4B.

The rotor 2 further includes a central bore 10 accommodating the pinion 19 integrated with the drive shaft 8 along the central axis of the rotor's rotation. Alternatively, FIG. 2 shows utilization of a stationary pinion oriented on the central rotating axis of the driving shaft fixed to an end cap with another pinion in the rotor further integrated with the driving shaft. In the preferred embodiment, the air transfer side plates 7 are ported identically. At the end of the pump toward the engine which will drive the drive shaft is mounted an intake end cap 6 with an intake end cap plenum 15. The plena 15 and 16 are hollowed out of the end caps or the end caps cast or molded with the plenum for each. The intake end cap plenum 15 is designed with a metal lobe into the plenum so that it does not ventilate the exhaust duct 18 of the shroud 1, and the exhaust end cap plenum 16 is designed with a metal lobe into the plenum so that it does not ventilate the intake duct 17. The exhaust end cap 9 is ported with an exhaust duct 18. The intake end cap 6 is ported with an intake duct 17. At the opposite end of the drive shaft 8 is an exhaust end cap 6. The end caps are ported with end cap ports 11. A pair of bearings 13 are normally situated on the drive shaft adjacent to the end cap. These bearings 13 are normally supported by the end caps 6 and 9. These stationary side transfer plates are in contact with the ends of the rotor, but have a clearance hole 12 through which the drive shaft passes to the bearing adjacent to the end cap. The drive shaft 8 is fixed to one or two smaller or larger diameter pinions (19) integrated on either side of a larger diameter rotor. These pinions (19) are supported by carbon-filled PEEK or similar bearing. The exhaust end cap 9 usually has a mounting bracket attached to one side as a means of attachment to the engine's accessory case which supports the spline drive to which the drive shaft normally connects. Each plenum 15 and 16 is thus a volume enclosed on one side by a air transfer side plates 7. The plena of the intake end cap plenum 15 and the end cap 6 with an end cap port 11 are shown in a side view in FIG. 1*a*.

The air transfer side plates 7 are preferably made from continuous carbon-fiber reinforced PEEK. These air transfer side plates 7 have an arrangement of ports which ventilate the working volumes of the rotary pump to the intake end cap plenum 15 and exhaust end cap plenum 16, respectively, in the intake end cap 6 and the exhaust end cap 9, respectively. A bronze oil-lite bearing may be used for the bearings 13. Such a bronze oil-lite bearing can function as an oil seal to prevent contamination from entering the pump, or an oil seal integral to the end cap may be used. Alternatively a non-metallic bearing may be used. The various parts of the pump are secured together by means of a plurality of screws or bolts 14.

The vanes 4 and air transfer side plates 7 for the rotary pump are preferably fabricated from a plurality of laminated layers of continuous carbon reinforced PEEK, and the rotor and other parts from metal. The carbon-fiber reinforced PEEK is a non-metallic composite material made from a weave of continuous carbon-fiber and PEEK cured in laminates in an autoclave. Various biasing of the carbon-fiber weave can be employed for tailored strength and lubricity. If a flat form or gradually curved form is desired, these forms are made by layering the carbon-fiber weave impregnated with the PEEK material. Under heat and pressure, the PEEK becomes less viscous and chemically combines with the carbon-fiber material. The laminate is then cured, normally under temperature and pressure in an autoclave. The resulting form has multiple layers usually with varying bias. If a round form for a bearing shroud or rotor is desired, the weave of continuous carbon-fibers impregnated with PEEK is wound under pressure on a mandril. As weaving of carbon, including carbon graphite material, and lamination processes are well known in the art, further description of such processes herein is deemed unnecessary. It will of course be understood that other fiber types, weave patterns, and fiber heat treatments may be substituted for the woven carbon fiber layers. All such forms of carbon to be laminated with PEEK are referred to as carbon fiber. The volume of PEEK required for the shroud and/or rotor of a typical sliding vaned rotary paddle pump is sufficiently great that its use for these components is not the preferred embodiment, however, the self-lubricating performance using these components to furnish lubricity between adjacent moving surfaces is not materially changed from the preferred embodiment of using a metallic shroud with the continuous carbon fiber reinforced PEEK sliding vanes interior to the shroud.

In this invention, the preferred method to add a self lubricating substance to the PEEK vanes would be to mix microspheres of a self-lubricating synthetic material with PEEK on the sliding vanes where desired.

Although several embodiments of the continuous carbon reinforced PEEK based material sliding vane for rotary pumps have been disclosed in the foregoing Detailed Description and illustrated in the accompanying Figure, it will be understood that other embodiments and modifications are possible without departing from the scope of the invention. The invention contemplates that of any two adjacent moving surfaces, one should be made of PEEK. Only a part of a surface in contact with a moving part not made of PEEK need be made of PEEK, meaning the side transfer plates could be made of PEEK for the part in contact with the rotor and the circumferential portion in contact with the PEEK sliding vanes could be made of metal. As another alternative, with more expense involved, the shroud can also be made of PEEK-containing material, but the preferred embodiment is to use a metallic shroud with the continuous carbon fiber reinforced PEEK sliding vanes interior to the shroud. Because the rotor speed relative to the side transfer plates may be sufficiently low, the side transfer plate could be made of only metal so long as the sliding vanes are made of continuous carbon fiber reinforced PEEK. An alternative application of continuous carbon-fiber reinforced PEEK would be as a thin self-lubricating liner fitted into a metallic shroud for use with metallic or other vane material, but the preferred embodiment is to use a metallic shroud with the continuous carbon-fiber reinforced PEEK sliding vanes interior to the shroud.

While the preferred embodiment is to use an ovoid cavity for the interior shape of the shroud with a centrally located rotor, it is well-known in the art and this invention can use a circular cavity for the interior shape of the shroud with an eccentric rotor.

The embodiments represented herein are only a few of the many embodiments and modifications that a practitioner reasonably skilled in the art could make or use. The invention is not limited to these embodiments nor to the versions encompassed in the figure which is intended as an aid to understanding the invention and is not meant to limit the disclosure or the claims. Alternative embodiments and modifications which would still be encompassed by the invention may be made by those skilled in the art, particularly in light of the foregoing teachings. Therefore, the following claims are intended to cover any alternative embodiments, modifications or equivalents which may be included within the spirit and scope of the invention as claimed.

We claim:

1. An improved sliding vane rotary paddle pump having a shroud and a cylindrical rotor, said rotor including a plurality of radial sliding vane slots, comprising:

at least two continuous carbon fiber reinforced polyetheretherketone sliding vanes symmetrically disposed in said radial sliding vane slots to engage said shroud for the pumping of a fluid through said rotary paddle pump, said at least two sliding vanes fabricated from a plurality of layers laminated together of a continuous carbon fiber reinforced polyetheretherketone material.

2. The improved sliding vane rotary paddle pump according to claim 1, further comprising:

said vane slots being canted with respect to a radial line from said rotor.

3. The improved sliding vane rotary paddle pump according to claim 2 further comprising:

said pump having a drive shaft;

shaft bearings fabricated from a plurality of layers laminated together of a continuous carbon fiber reinforced polyetheretherketone material.

4. The improved sliding vane rotary paddle pump according to claim 1, further comprising:

said pump having a drive shaft;

said drive shaft being integrated with at least one pinion adjacent to said rotor.

5. The improved sliding vane rotary paddle pump according to claim 4 further comprising:

a coating selected from the group of self-lubricating synthetic materials including polytetrafluoroethylene on or in at least one of any two adjacent non-polyetheretherketone surfaces in relative motion one-to the other during operation of said rotary paddle pump.

6. The improved sliding vane rotary paddle pump according to claim 4 further comprising:

shaft bearings fabricated from a plurality of layers laminated together of a continuous carbon fiber reinforced polyetheretherketone material.

7. The improved sliding vane rotary paddle pump according to claim 1, further comprising:

said vane slots being canted with respect to a radial line from said rotor, and said pump having a drive shaft;

said drive shaft being integrated with at least one pinion adjacent to said rotor.

8. The improved sliding vane rotary paddle pump according to claim 7, further comprising:

shaft bearings fabricated from a plurality of layers laminated together of a continuous carbon fiber reinforced polyetheretherketone material.

9. An improved sliding vane rotary paddle pump having a shroud, a cylindrical rotor, said rotor including a plurality of radial sliding vane slots, and two air transfer side plates comprising:

at least two continuous carbon fiber reinforced polyetheretherketone sliding vanes symmetrically disposed in said radial sliding vane slots to engage said shroud for the pumping of a fluid through said rotary paddle pump, said at least two sliding vanes fabricated from a plurality of layers laminated together of a continuous carbon fiber reinforced polyetheretherketone material; and a coating selected from the group of self-lubricating synthetic materials including polytetrafluoroethylene on at least one of any two adjacent non-polyetheretherketone surfaces in relative motion one-to-the-other during operation of said rotary paddle pump.

10. The improved sliding vane rotary paddle pump according to claim 9, further comprising:

said vane slots being canted with respect to a radial line from said rotor.

11. The improved sliding vane rotary paddle pump according to claim 10, further comprising:

said pump having a drive shaft;

said drive shaft being integrated with at least one pinion adjacent to said rotor.

12. The improved sliding vane rotary paddle pump according to claim 11, further comprising:

shaft bearings fabricated from a plurality of layers laminated together of a continuous carbon fiber reinforced polyetheretherketone material.

13. An improved sliding vane rotary paddle pump having a shroud, and a cylindrical rotor, said rotor including a plurality of radial sliding vane slots, comprising:

at least two continuous carbon fiber reinforced polyetheretherketone sliding vanes symmetrically disposed in said radial sliding vane slots to engage said shroud for the pumping of a fluid through said rotary paddle pump, said at least two sliding vanes fabricated from a plurality of layers laminated together of a continuous carbon fiber reinforced polyetheretherketone material; and air transfer side plates fabricated from a plurality of layers laminated together of a continuous carbon fiber reinforced polyetheretherketone material at least where said side plates are in contact with said rotor.

14. The improved sliding vane rotary paddle pump according to claim 13, further comprising:

said vane slots being canted with respect to a radial line from said rotor.

15. The improved sliding vane rotary paddle pump according to claim 14, further comprising:

said pump having a drive shaft;

said drive shaft being integrated with at least one pinion adjacent to said rotor.

16. The improved sliding vane rotary paddle pump according to claim 15, further comprising:

shaft bearings fabricated from a plurality of layers laminated together of a continuous carbon fiber reinforced polyetheretherketone material.

17. An improved sliding vane rotary paddle pump having a shroud, and a cylindrical rotor, said rotor including a plurality of radial sliding vane slots, comprising:

at least two continuous carbon fiber reinforced polyetheretherketone sliding vanes symmetrically disposed in said radial sliding vane slots to engage said shroud for the pumping of a fluid through said rotary paddle pump, said at least two sliding vanes fabricated from a plurality of layers laminated together of a continuous carbon fiber reinforced polyetheretherketone material;

air transfer side plates fabricated from a plurality of layers laminated together of a continuous carbon fiber reinforced polyetheretherketone material at least where said side plates are in contact with said rotor;

said pump having a drive shaft;

shaft bearings fabricated from a plurality of layers laminated together of a continuous carbon fiber reinforced polyetheretherketone material.

18. The improved sliding vane rotary paddle pump according to claim 17, further comprising:

said vane slots being canted with respect to a radial line from said rotor.

19. The improved sliding vane rotary paddle pump according to claim 18, further comprising:

said pump having a drive shaft;

said drive shaft being integrated with at least one pinion adjacent to said rotor.

* * * * *